United States Patent [19]

Hashimoto et al.

[11] 4,412,411

[45] Nov. 1, 1983

[54] PAPER SHEET BUNDLING APPARATUS

[75] Inventors: Yoshiro Hashimoto; Shigeo Horino, both of Tokyo, Japan

[73] Assignee: Tokyo Shibaura Denki Kabushiki Kaisha, Kawasaki, Japan

[21] Appl. No.: 414,313

[22] Filed: Sep. 2, 1982

Related U.S. Application Data

[63] Continuation of Ser. No. 133,940, Mar. 25, 1980, abandoned.

[30] Foreign Application Priority Data

| | | | |
|---|---|---|---|
| Mar. 28, 1979 | [JP] | Japan | 54-36730 |
| Mar. 28, 1979 | [JP] | Japan | 54-36731 |
| Mar. 28, 1979 | [JP] | Japan | 54-36732 |
| Mar. 29, 1979 | [JP] | Japan | 54-37508 |
| Mar. 29, 1979 | [JP] | Japan | 54-37509 |
| Mar. 29, 1979 | [JP] | Japan | 54-37510 |
| Mar. 29, 1979 | [JP] | Japan | 54-41038[U] |

[51] Int. Cl.[3] ..... B65B 11/04

[52] U.S. Cl. ..... 53/587

[58] Field of Search ..... 53/211, 542, 587, 588, 53/589; 100/15

[56] References Cited

U.S. PATENT DOCUMENTS

| | | | |
|---|---|---|---|
| 1,123,606 | 1/1915 | Smith | 53/587 |
| 1,190,848 | 7/1916 | Batdore | 53/528 |
| 3,955,340 | 5/1976 | Tomita | 53/587 |
| 3,994,118 | 11/1976 | Felix | 53/587 |
| 4,014,731 | 3/1977 | Muto | 53/587 |
| 4,020,616 | 5/1977 | Nakajima | 53/587 |
| 4,126,983 | 11/1978 | Ito | 53/593 |
| 4,178,734 | 12/1979 | Lancaster | 53/399 |
| 4,283,903 | 8/1981 | Mayhall | 53/587 |

*Primary Examiner*—John Sipos

*Attorney, Agent, or Firm*—Cushman, Darby & Cushman

[57] ABSTRACT

In a paper sheet bundling apparatus for a paper sheet processing system, a thermally fusible bundling tape is wound round a paper sheet stack, and the trailing end of the tape is thermally bonded to a portion of the tape wound round the stack by a heating means. The bonding operation is effected on a heat receiving member interposed between the paper sheet stack and the tape wound thereround. The heat receiving member has a back side, outwardly curved contact surface, against which one edge portion of the paper sheet stack is urged and curved along it by a pressing lever in an initial stage of the bundling operation commencing with the rotation of a rotary body.

3 Claims, 16 Drawing Figures

PAPER SHEET BUNDLING APPARATUS

This is a continuation of application Ser. No. 133,940 filed Mar. 25, 1980 to be abandoned as of the filing date accorded this application.

This invention relates to a paper sheet bundling apparatus, which is employed in a paper sheet processing system or sorting machine for sorting paper sheets such as bank notes, checks, share-certificates or advice slips into a group of normal sheets, a group of soiled sheets, a group of unidentifiable sheets and so forth.

The bundling apparatus of this kind serves to bundle a stack of a predetermined number of sorted paper sheets belonging to a group by winding a bundling tape round the stack and gluing the cut end of the tape to a portion thereof wound on the stack and feed out the bundled paper sheet stack to the next processing step.

FIG. 1 shows a well-known paper sheet processing machine. In this machine, paper sheets are processed in a manner as mentioned hereinbelow. A predetermined number of, for instance 1,000, paper sheets a to be processed are set in the machine, and they are taken out one after another and successively supplied to a transfer system c with the rotation of a take-out roller b. During their transfer through the transfer system c, the supplied paper sheets a pass through sheet discriminators d and e, which discriminate normal sheets, soiled sheets and unidentifiable sheets. The sheets which are determined to be unidentifiable sheets are fed into, for instance, a recovery box f. The other sheets are further transferred, and the normal sheets and soiled sheets are collected in respective collection boxes g and h through switching of gates. When a predetermined unit number of, for instance 100, sheets are collected in the respective collection boxes g and h, this stack of paper sheets is taken out from said boxes g and h and respectively conveyed downwards as shown by the corresponding arrows i and j and then transferred onto a belt conveyor system k which is disposed below the collection boxes g and h. Each stack of paper sheets transferred to the belt conveyor system k is transferred thereby in the direction of arrow l and fed into a bundling apparatus m. In the bundling apparatus m, a bundling tape p is paid off a roll n and wound round the paper sheet stack which is located in a bundling position, and after the tape is cut by a cutter (not shown) the cut end of the tape is bonded to a portion thereof wound on the stack. The resulting bundled paper sheet stack is fed out to a belt conveyor system q to be dropped into a recovery container t in the direction of arrows s, and finally it is discharged to the outside of the machine.

In connection with such bundling apparatus for paper sheet processing machines or systems, it has been proposed as an improvement to use a bundling tape of a thermally fusible material. In the prior art, paper tape has mostly been used as the bundling tape, and the tape end has been glued for bonding. In this case, there have been various problems such as the complicated construction of a glue feeder mechanism, lack of reliability of bonding due to possible drying of the glue before the completion of bonding and the possibility of glue striking the paper sheet stack. The thermally fusible tape can practically overcome the above various drawbacks although it additionally requires a heating means, and some apparatuses using such tape are in practical use.

However, the thermally fusible tape still presents some problems. One of the problems is that where the process of fusing the two portions of the tape is carried out directly on the surface of the paper sheet stack, then components of the tape tend to flow out and consequently stick to the paper sheet stack. If this occurs, the paper sheets are likely to be spoiled.

In another aspect, with a well-known bundling apparatus, the stack of paper sheets is curved prior to the bundling operation, and in this state it is bundled with a tape and regains its original state due to its own recoiling property. This is effective for providing a tension to the bundling tape and enables more firm and compact bundling of the paper sheet stack.

For giving such a curve to the paper sheet stack, the prior-art apparatus uses upper and lower curved clamp plates as a pair. These paired clamp plates serve to clamp the paper stack in a bundling position between them, and are capable of making mutual movement between a clamp position and a clear position while they are being held parallel to each other. Such curved clamp plates, however, have to be spaced apart a great distance in their clear position to permit the paper sheet stack to be fed into and out of the space between them.

In a further aspect, in the prior-art apparatus a mechanism for operating the clamp plates uses an axially slidable truncated conical cam which requires a comparatively large space.

The prior-art bundling apparatus also has various other problems; for instance, a feed-in mechanism for feeding paper sheet stacks into the bundling position has certain drawbacks to be overcome.

An object of the invention is to preclude the aforementioned various problems inherent in the prior-art apparatus by the provision of a paper sheet bundling apparatus, which can reliably bundle paper sheet stacks without the possibility of attachment of the adhesive material of the bundling tape to the tape sheet, as well as being simple in construction and compact.

In order to achieve the above object, with the bundling apparatus according to the invention, a plate-like heat receiving member is held interposed between a paper sheet stack and a thermally fusible tape wound therearound during the bundling operation. A heating member is disposed facing the receiving member at a heating position so that the trailing end of the tape is thermal fusion bonded to a portion of the tape wound on the paper sheet stack by the heating member on the heat receiving member.

Thus, even if the adhesive of the tape flows out during the bonding operation, it never directly attaches to the stacked paper sheets. In addition, since the heat receiving member is present, the tape can be heated while being sufficiently pressed by the heating member, thus permitting satisfactory and reliable bonding to be obtained.

According to the invention, the heat receiving member is formed on its back side, that is, the side of stacked paper sheets, with an outwardly curved contact surface, against which the paper sheet stack is urged by a rockable pressing lever in an initial stage of the bundling operation.

Thus, it is possible to obtain reliable operation of curving the paper sheet stack. In addition, the upper and lower clamp plates may be straight plates, and also the distance of their relative movement can be reduced to improve compactness. Particularly, it is a very useful feature of the invention that the heat receiving member serves the two roles, with its front side receiving heat and its back side is used as a contact surface for curving the paper sheet stack.

Further, according to the invention a plate cam adapted to rock in a vertical plane is used for operating the upper and lower clamp plates, and the space required for its operation is considerably reduced compared to the prior-art truncated conical cam.

The above and other objects, features and advantages of the invention will become more apparent from the description of the preferred embodiments thereof when the same is read with reference to the accompanying drawings.

Figure 1:
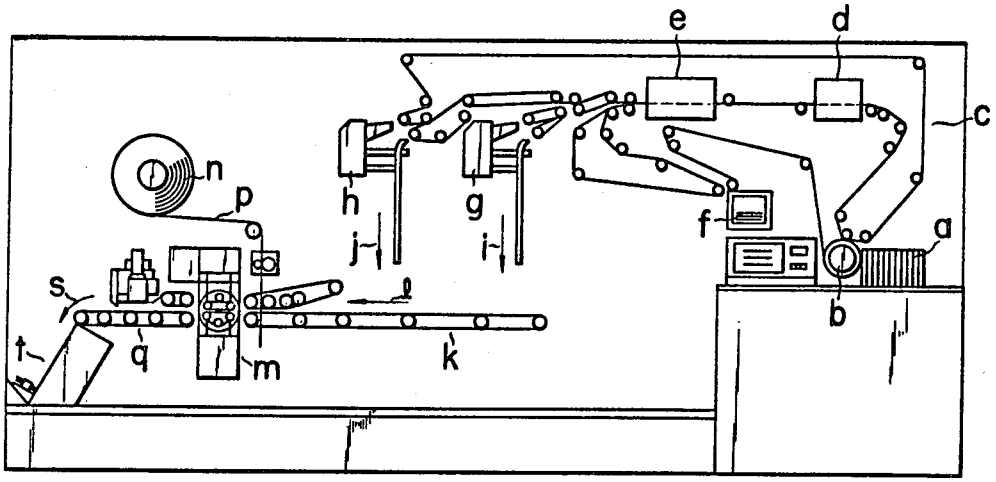
FIG. 1 PRIOR ART
FIG. 1 is a schematic view of a prior-art paper sheet processing system incorporating a well-known bundling apparatus.
Figure 2:
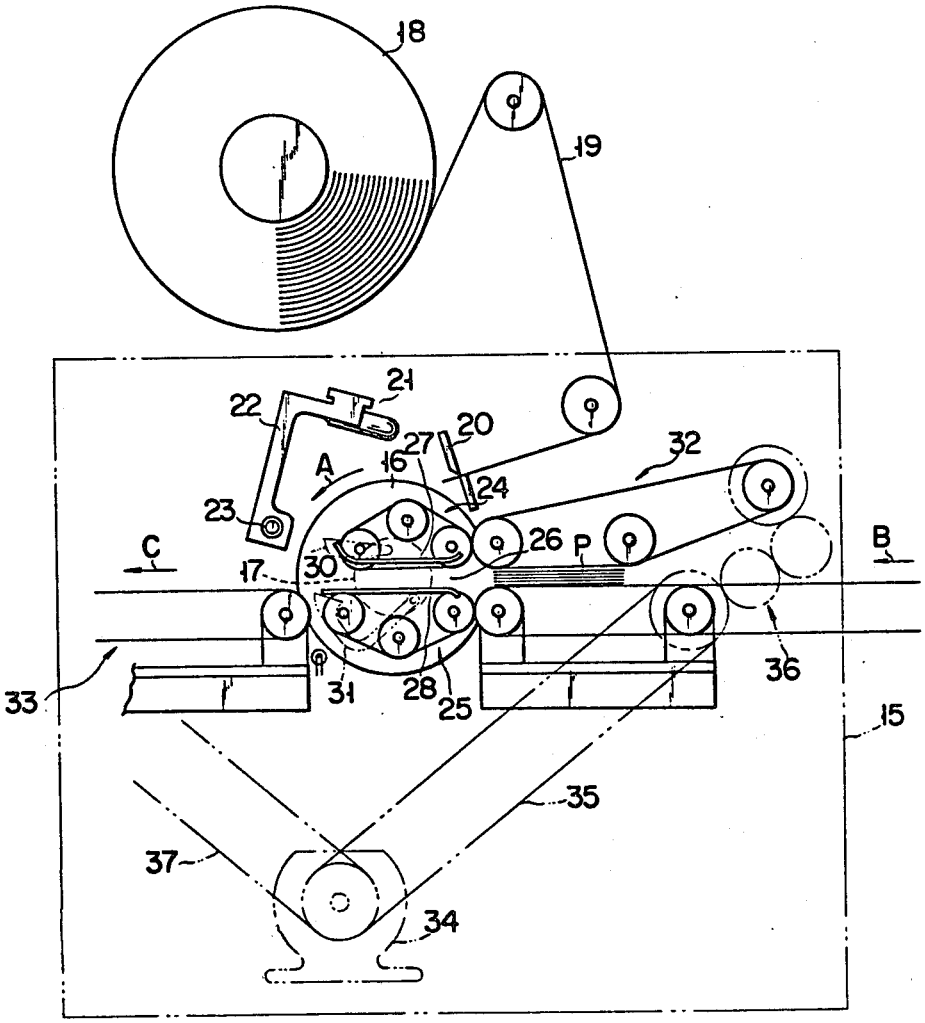
FIG. 2 is a schematic view of a bundling apparatus according to the invention.
Figure 4:
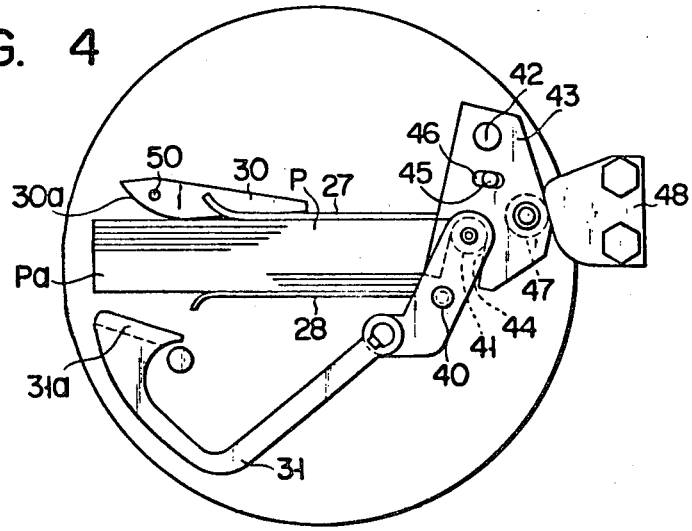
Figure 5:
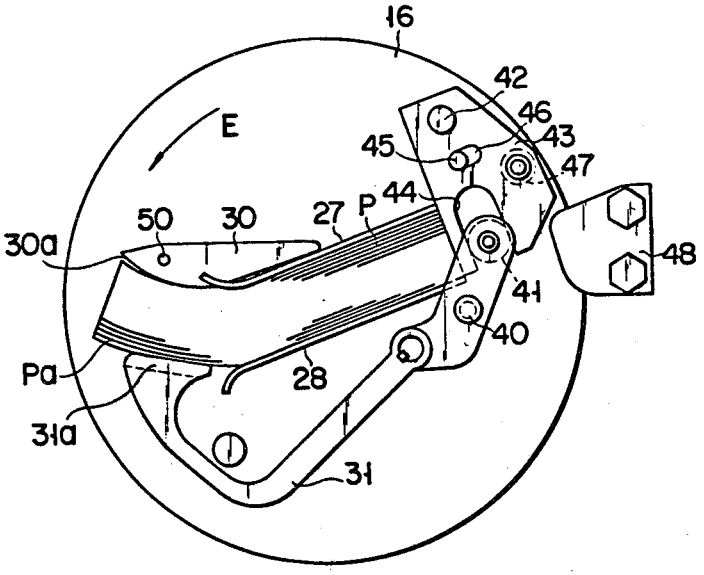
Figure 6:
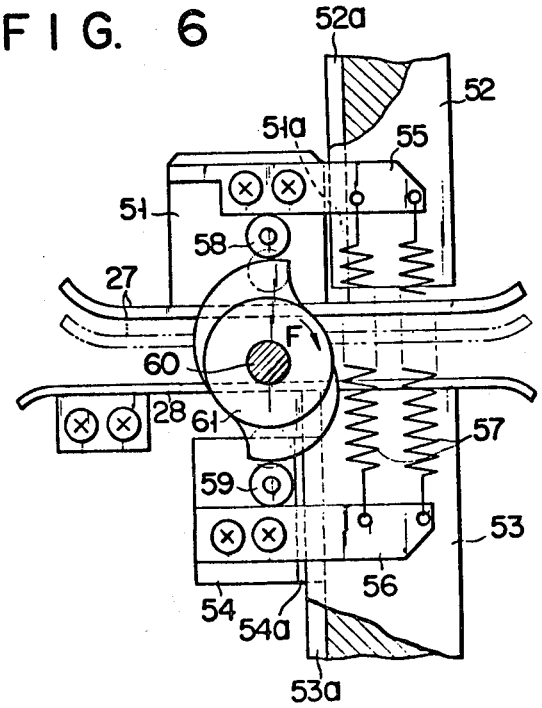
Figure 7:
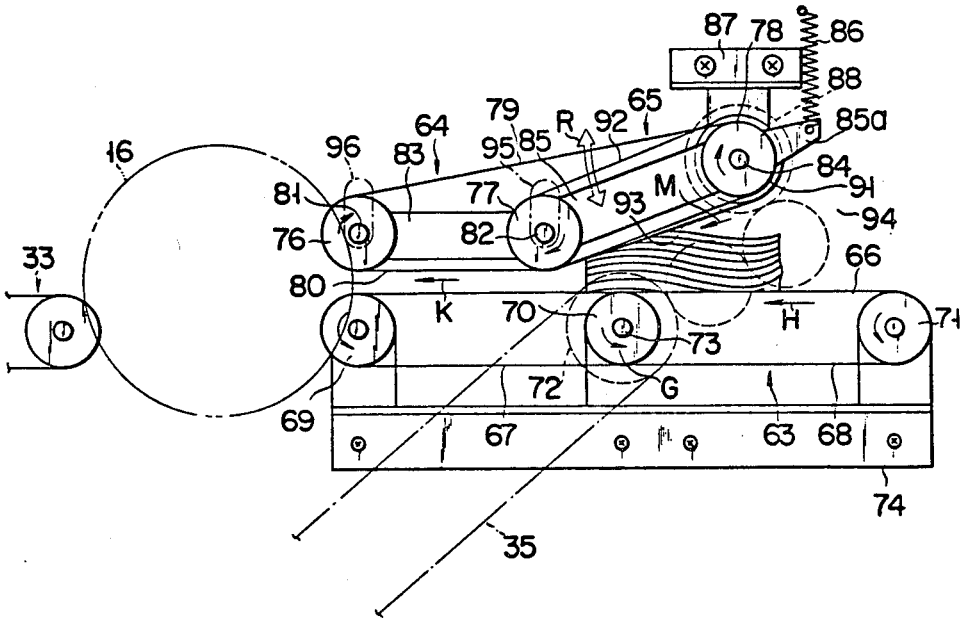
Figure 8:
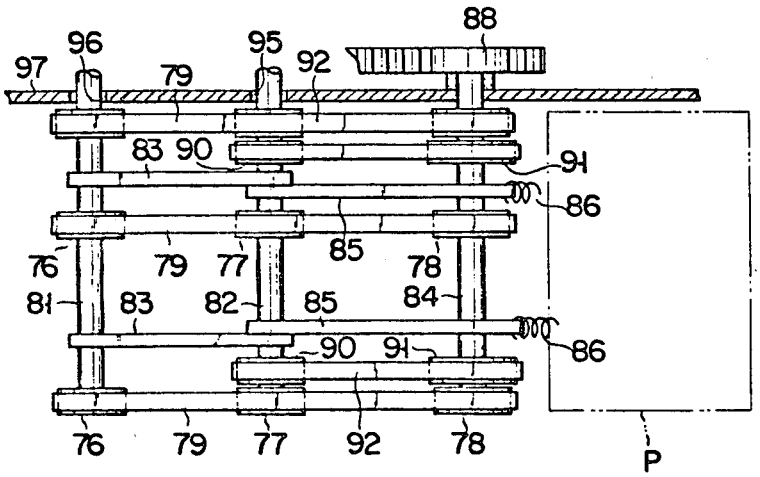
Figure 9:
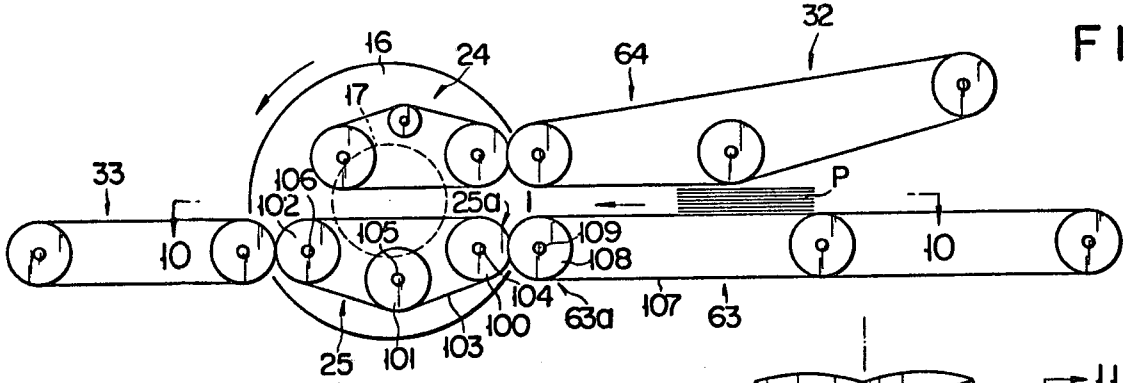
Figure 10:
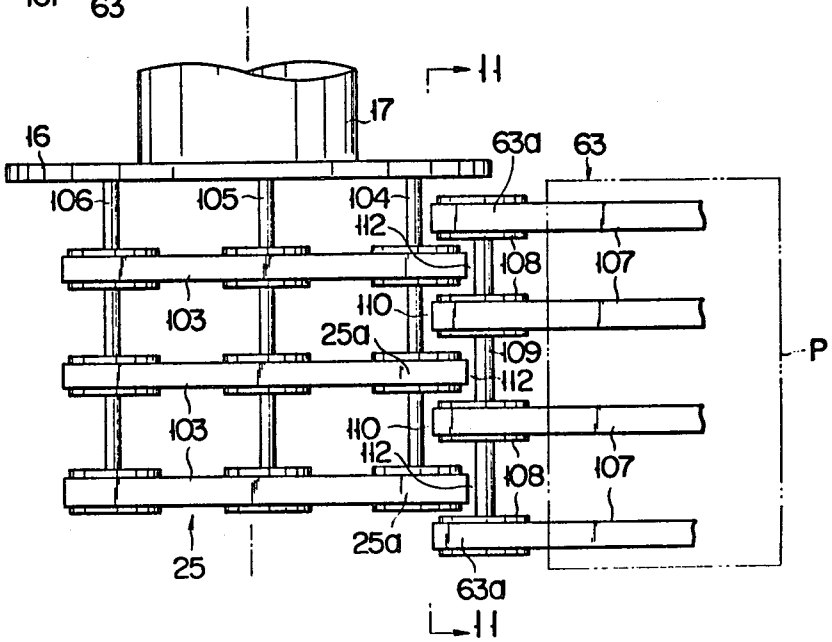
Figure 11:
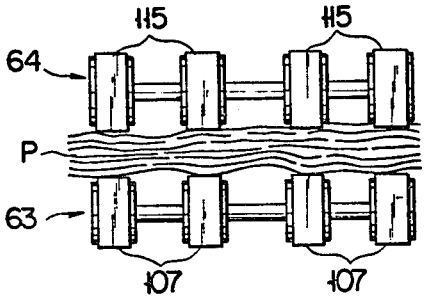
Figure 12:
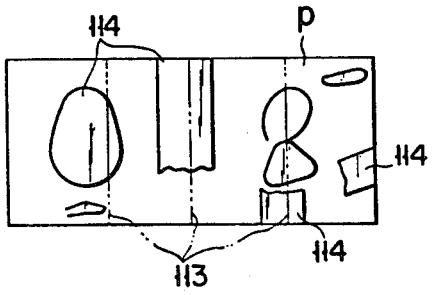

FIGS. *3a* to *3e* are views of a series of bundling operation steps of a part of the apparatus shown in FIG. 2;

FIG. 4 is a fragmentary enlarged-scale view of a mechanism of curving a stack of paper sheets;

FIG. 5 is a view similar to FIG. 4 but showing the mechanism in a different operational state;

FIG. 6 is a fragmentary enlarged-scale view of a mechanism for clamping a stack of paper sheets;

FIG. 7 is a schematic view of an example of a feed-in mechanism of the bundling apparatus embodying the invention;

FIG. 8 is a fragmentary schematic plan view of part of the feed-in mechanism shown in FIG. 7;

FIG. 9 is a schematic view of an improved paper sheet transfer system of the bundling apparatus embodying the invention;

FIG. 10 is a fragmentary enlarged-scale view taken along line 10—10 in FIG. 9;

FIG. 11 is a view taken along line 11—11 in FIG. 10 and showing the position of spaced-apart transfer belts relative to stacked paper sheets held therebetween; and FIG. 12 is a plan view of a process paper sheet having repaired portions.

The preferred embodiments of the invention will now be described with reference to the accompanying drawings, particularly FIGS. 2 to 12.

Referring now to FIG. 2, the paper sheet bundling apparatus according to the invention has a rotary body 16 mounted for rotation in the direction of arrow A in a stationary frame 15 as shown by the broken lined rectangle. The body 16 is supported on a shaft 17 shown by broken line. A reel 18, as a bundling tape feeder means; is disposed above rotary body 16, and a tape 19 from the reel is guided around guide rollers 19 and through a cutter 20 to the body 16. The tape 19 is a thermally fusible tape, the material of which is partly fused by application of heat and acts as adhesive. The material of the tape may, for instance, be a vinyl acetate resin, a water soluble olefin resin or a water soluble acrylic resin, which may be coated on a paper base. A heating means for heating the thermally fusible tape comprises a heating member 21 supported by a heater arm 22 which is in turn pivotably mounted by a shaft 23 on the frame 15. Swinging of the arm 22 from its inoperative position shown in FIG. 2 to a heating position shown in FIG. *3e* is caused by a suitable drive mechanism (not shown).

The rotary body 16 is provided with upper and lower endless belt transfer assemblies 24 and 25 each including an endless belt and a plurality of rollers. The transfer assemblies 24 and 25 serve to locate a paper sheet stack P in a bundling position shown in FIG. *3b*. A passage 26 for passing the paper sheet stack P is defined between the two transfer assemblies. In a normal position of the rotary body 16 shown in FIG. 2 before the handling operation, the passage 26 is horizontal.

Together with the upper and lower transfer assemblies 24 and 25 corresponding upper and lower clamp plates 27 and 28 are mounted in the rotary body 16. The clamp plates 27 and 28 are substantially flat plates which can be brought close to or away from each other while being held parallel to each other. In FIG. 2, these plates are shown in their position, at which they are spaced apart to the farthest extent (hereinafter referred to as clear position). They are driven from the clear position to a position at which they are closest to each other (hereinafter referred to as clamp position), and the details of this driving will be described later. The role of these clamp plates 27 and 28 is to hold the paper sheet stack P in the bundling position clamped between them during the bunding operation so that the paper sheets will not fall from the rotary body 16 which is rotated.

In a portion corresponding to the left hand end of the upper clamp plate 27 in FIG. 2, a heat receiving member 30 shown by a broken line is disposed. Although not shown, this heat receiving member 30 is capable of being advanced and retreated in a crosswise direction with respect to the direction B or C of transfer of the paper sheet stack P, that is, in a direction perpendicular to the paper of the Figure. This heat receiving member 30 is adapted to be moved in unison with the upper clamp plate 27 at the time when the clamp plates are brought to their clamp position.

A pressing lever 31, which is schematically shown by broken lines in FIG. 2, is rockably mounted in the rotary body 16. Its role is to curve the stacked paper sheets prior to or in an initial stage of the bundling operation, as will be described later in detail in connection with FIGS. 4 and 5.

On the right hand side of the rotary body 16, a paper sheet stack feed-in device or assembly 32 for feeding the paper sheet stack P, which has been transferred in the direction of arrow B from the previous step, into the space between the upper and lower transfer assemblies 27 and 28 is disposed within the stationary frame 15. On the left hand side of the body 16, that is, on the side of the body 16 diametrically opposite the feed-in device 32, a paper sheet bundle feed-out device or assembly 33 is disposed within the stationary frame 15. The feed-out device 33 has a role of receiving the paper sheet bundle P from the transfer assemblies 24 and 25 and feeding it out in the direction of arrow C to the next step.

A drive motor 34 shown by a broken line for driving the feed-in and feed-out devices 32 and 33 is disposed within the stationary frame 15, and its driving force is transmitted through a drive belt 35 and a gear train 36 shown by broken lines to the feed-in device 32 and also through a drive belt 37, partly shown in the Figure, to the feed-out device 33.

The operation of bundling the paper sheet stack P will now be described with reference to FIGS. *3a* to *3e*.

As shown in FIG. *3a*, the paper sheet stack P is horizontally fed from the feed-in device 32 in the leftward direction into the passage 26 defined between the upper and lower transfer assemblies 24 and 25 until it is located in a bundling position as shown in FIG. *3b*. In this step, the depending or leading end portion 19*a* of the tape 19 is pushed by the leading end of the paper sheet stack P, and thus it rests on the stack P as shown in FIG.

3*b*. At this time, the clamp plates 27 and 28 are in their clear position so that the leading end of the tape enters a space between the heat receiving member 30 and the top of the stack P.

Subsequently, the stack P is clamped by the upper and lower clamp plates 27 and 28. At this time, the outwardly curved surface 30*a* of the back side of the heat receiving member 30 is brought close to the left hand or front edge portion of the stack P.

As is seen from FIGS. 4 and 5, when the stack P is in the bundling position, the edge portion Pa of it projects from the clamp plates 27 and 28 and is not clamped thereby.

Figure 3A:
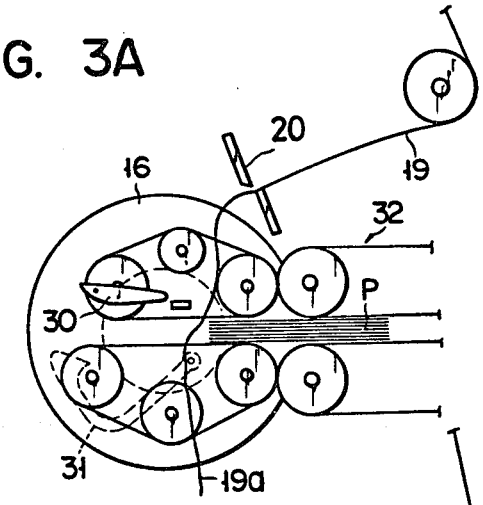
Figure 3B:
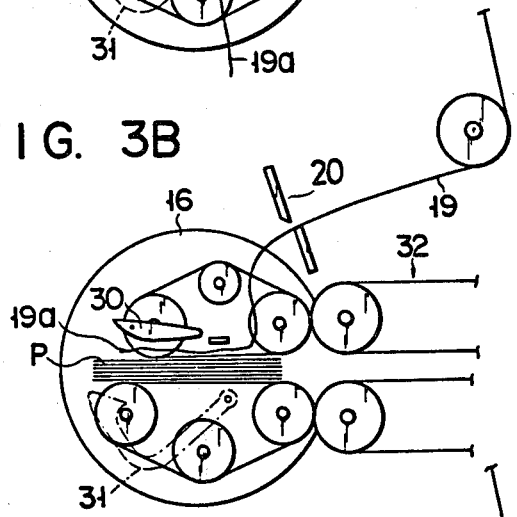
Figure 3C:
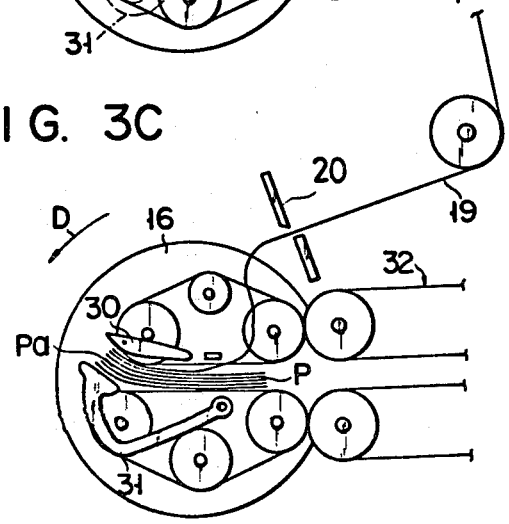

The rotary body 16 starts rotation from its normal position in the counterclockwise direction as shown by arrow D. With the commencement of the rotation, that is, in an initial stage of the bundling operation, swinging of the pressing lever 31 in the clockwise direction is caused, and the pressing lever 31 is brought into engagement with the underside of the edge portion Pa of the stack P to upwardly curve that portion, thus urging the upper side of the portion Pa against the curved surface 30*a* of the heat receiving member 30, as shown in FIG. 3*c*. Thus, the portion Pa assumes a curved form complementary to the form of the curved surface 30*a*. During the subsequent period of the bundling operation, the pressing lever 31 holds the portion Pa in this curved form.

Figure 3D:
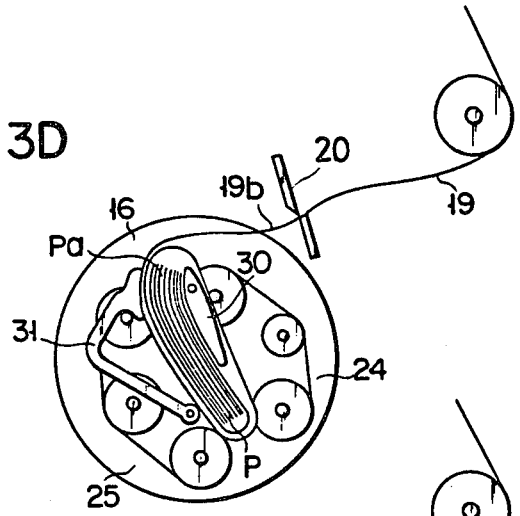

FIG. 3*d* shows the rotary body 16 having been rotated by one and three-fourth rotations from its initial position. In this state, the tape 19 is doubly wound round the stack P. At this time, the tape 19 is cut by the cutter 20, and the cut end or trailing end 19*b* of the tape is overlapped over the tape portion wound round the stack P.

As is shown in FIG. 3*d*, the heat receiving member 30 is found between the upper turn of the tape 19 wound round the stack P and the upper side thereof. This means that the heat receiving member 30 is bundled together with the stack P during the bundling operation.

Figure 3E:
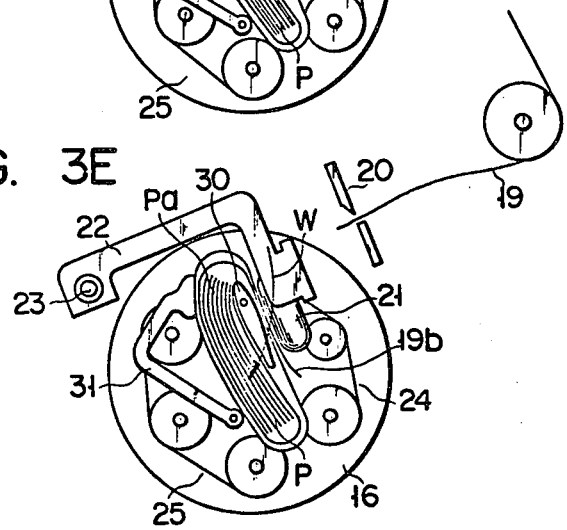

Subsequently, clockwise swinging of the heater arm 22 from its inoperative position to a heating position as shown in FIG. 3*e* is caused. In this position of the heater arm, the heating member 21 faces the heat receiving member 30, and it effects thermal fusion bonding of the trailing cut end 19*b* of the tape 19 to a tape portion wound round the stack P through heating on the heat receiving member 30. Since the bonding operation is performed on the heat receiving member 30, there is no possibility for the adhesive to directly attach to the paper sheets. Also, since the heat receiving member 30 is present, the trailing end 19*b* of the tape can be heated while being urged against the tape portion wound round the stack P with a sufficient force, so that it is possible to obtain reliable bonding.

Further, as shown by an arrow W in FIG. 3*e*, the heater 21 does not perpendicularly abut against a tape set on the heat-receiving member 30, but in an inclined direction. Said abutment is carried out obliquely in the direction in which the trailing end portion 19*b* of the tape is wound about the stack P. In other words, the force with which the heater 21 is pressed against the tape includes a component acting along the surface of the tape. Therefore, as the heater 21 abuts against the tape, then the trailing end portion 19*b* of the tape tends to be wound about the stack P to a greater extent instead of being recoiled. Since, as described above, the heater 21 abuts against the tape in an inclined direction, the tape is fused to the stack P while sliding somewhat forward, thereby elevating the adhesion of the tape to the stack.

After the bonding of the tape is ended, the heater arm 22 is returned to the inoperative position, and the rotary body 16 is further rotated in the counterclockwise direction until it assumes again its normal position. Also, the pressing lever 31 is returned to the inoperative position, and the clamp plates 27 and 28 are returned to the clear position, thus bringing an end to one cycle of the building operation. During one bundling cycle the rotary body 16 executes two rotations.

The bundled paper sheet stack P is transferred by the upper and lower transfer assemblies 24 and 25 from the bundling position to the feed-out device 33.

Although it is impossible to understand from FIGS. 2 and 3*a* to 3*e*, the various members mounted in the rotary body 16, that is, the heat receiving member 30, pressing lever 31 and upper and lower transfer assemblies 24 and 25 are spaced apart from one another in the crosswise direction, so that they never interfere with one another.

In FIG. 5, the rotary body 16 is shown in its normal position, and the upper and lower clamp plates 27 and 28 are shown in their clamp position. FIG. 4 shows the pressing lever 31 in its inoperative position, and FIG. 5 shows it in its operative or pressing position.

The pressing lever 31 is pivoted by a pin 40 to the rotary body 16 and has a substantially L-shaped arm having an enlarged end defining a press surface 31*a*. The other arm of the lever 31 is provided at the end with a follower roller 41, which is received in a cam groove 44 formed in a lever operating member 43 pivoted by a pin 42 to the rotary body 16. The operating member 43 is pivotable within a predetermined angle range provided by the engagement between a pin 45 projecting from the rotary body 45 and a slot 46 formed in the member 43 and receiving the pin 45. The member 43 is also biased by a suitable spring (not shown) for rotation about the pin 42 in the counterclockwise direction. The biasing spring may be one which is wound on the pin 42 with its one end tied to the rotary body and its other end tied to the operating member, and this spring design may be readily understood by one skilled in the art. The member 43 also carries a cam follower roller 47, which is adapted to engage with a cam block 48 secured to the stationary frame.

When the rotary body 16 is in the normal position shown in FIG. 4, the cam follower roller 47 of the lever operating member 43 is in engagement with the cam block 48 and held against the counterclockwise biasing force to hold the pressing lever 31 in the inoperative position.

With the commencement of rotation of the rotary body 16 in the counterclockwise direction as shown by arrow E in FIG. 5, the cam follower roller 47 is separated from the stationary cam block 48. As a result, the operating member 43 is caused to swing counterclockwise about the pin 42 against the spring force up to a position, at which the pin 45 engages with the left end of the slot 46. This swinging motion is transmitted through the engagement between the cam groove 44 and follower roller 41 to the pressing lever 31. Thus, the lever 31 is caused to swing clockwise about the pin 40, so that the press surface 31*a* is urged against the underside of the front edge portion Pa of the paper sheet track P. Consequently, the edge portion Pa is curved along the back side curved surface 30*a* of the heat receiving member 30 by the pressing lever 31 as mentioned earlier.

While the rotary body 16 executes two rotations during one bundling cycle, when it completes the first rotation and reaches again its normal position the roller 47 is again brought into engagement with the stationary cam block 48, and at this time the pressing lever 31 is momentarily retracted from the pressing position. However, since the rotary body 16 executes continual rotation, the pressing lever 31 is brought back to the pressing position right after the cam follower roller 47 gets out of the engagement. Thus, it may be thought that the pressing lever 31 holds the edge portion Pa of the paper sheet stack P in the curved form throughout the bundling cycle. It is possible, however, to prevent the roller 47 from engaging again with the stationary cam block 48 at the time of the completion of the first rotation of the rotary body 16 by arranging such that the cam block 48 is retreated on the frame 15 in a suitably timed relation to the rotation of the rotary body 16.

The heat receiving member 30 has a substantially flat top surface while it has the curved surface 30*a* on the back side. It has a shaft 50.

In FIG. 6, the upper clamp plate 27 is provided with an integral upper block 51, which is guided for vertical movement by a support frame 52 integral with the rotary body 16. The guide is effected by the engagement between a rail 51*a* projecting from a side edge of the block 51 and a rail groove 52*a* formed in the corresponding side edge of the support frame 52.

The lower clamp plate 28 is secured to another support frame 53 integral with the rotary body 16, and a lower block 54 is guided for vertical movement by the frame 53. This guide is effected in a manner similar to that mentioned above, namely by the engagement between a rail 54*a* provided on a side edge of the lower block 54 and a rail groove 53*a* formed in the corresponding side edge of the support frame 53.

The upper and lower blocks 51 and 54 have respective integral extensions 55 and 56, between which tension springs 57 are stretched. They carry respective cam followers 58 and 59, which are in engagement with the outer periphery of a plate cam 61 rotatable about a shaft 60. The shaft 60 extends in the crosswise direction, and the plate cam 61 is rockable in a vertical plane about the shaft 60.

In FIG. 6, the two clamp plates 27 and 28 are shown in their clear position, that is, they are spaced apart farthest, with the cam followers 58 and 59 resting on the highest cam edge portions of the plate cam 61. In the clamp position of the clamp plates 27 and 28, the cam followers 58 and 59 are in engagement with the lowest cam edge portions, that is, the clamp plates are brought from their clear position to clamp position with the swinging of the cam 61 in the direction of arrow F. The tension springs 57 are biasing both the clamp plates 27 and 28 toward each other, that is, to the clamp position.

The plate cam which is used according to the invention has an advantage that it requires a comparatively small design space.

Referring now to FIG. 7, the paper sheet stack feed-in device 32 comprises first, second and third belt-and-roller assemblies 63, 64 and 65. These belt-and-roller assemblies individually consist of a plurality of parallel belt-and-roller units, but for the sake of brevity of description these assemblies will each be described as one consisting of a single belt-and-roller unit.

The first belt-and-roller assembly 63 includes two endless belts 67 and 68 defining a substantially horizontal first belt transfer surface 66 and three rollers 69, 70 and 71 of an equal diameter spaced apart in a horizontal plane, with the belt 67 passed around the rollers 69 and 70 and the belt 68 passed around the rollers 70 and 71. The center roller 70 is connected through a shaft 73 to a drive pulley 72 shown by broken lines, and is driven in the direction of arrow G from the drive motor 34 via the drive belt 35. As the center roller 70 is driven, the opposite side rollers 69 and 71 are also driven in the same direction, and the first belt transfer surface 66 is moved in the direction of arrow H at a first predetermined speed. The paper sheet stack P is placed on this transfer surface 66. The three rollers 69, 70 and 71 are rotatably supported by a support frame 74 secured to the stationary frame 15.

The second belt-and-roller assembly 64 includes front and middle rollers of an equal diameter and spaced apart in a horizontal plane, a rear roller 78 extending at a higher level than the rollers 76 and 77 and an endless belt 79 passed around these rollers. The belt 79 defines a second belt transfer surface substantially parallel to the first belt transfer surface 66. The role of this second belt-and-roller assembly 64 is practically played by the second belt transfer surface 80. Of the shafts of the three rollers the shafts 81 and 82 are connected together by a connecting arm 83, and the shafts 82 and 84 are connected together with another connecting arm 85. The connecting arm 85 has an extension 85*a*, which is biased with a spring 86. The shaft 84 of the rear roller 78 is rotatably supported by a support member 87 secured to the stationary frame 15. It carries a drive gear 88, which is coupled through a gear train to the center roller shaft 73 in the first belt-and-roller assembly 63, and the three rollers 76, 77 and 78 are driven such that the second belt transfer surface 80 is moved in the direction of arrow K at the same speed as the first belt transfer surface 66, i.e., first predetermined speed.

The third belt-and-roller assembly 65 includes a roller 90 which is coaxial with and has the same diameter as the center roller 77 in the second belt-and-roller assembly 64, a roller 91 which is coaxial with and has a greater diameter than the rear roller 78 in the second assembly 64 and an endless belt 92 passed round the rollers 90 and 91. The roller 90 is clearly shown in FIG. 8. The large diameter roller 91 gives a higher belt transfer speed to the endless belt 92 than that given by the small diameter roller 78 to the endless belt 79, so that an inclined third belt transfer surface 93 defined by the belt 92 is moved in the direction of arrow M at a second transfer speed which is higher than the speed of the first and second transfer surfaces 66 and 80.

Denoting the first and second transfer speeds respectively by $V_1$ and $V_2$ and the inclination angle of the third belt transfer surface 93 with respect to the horizontal by $\alpha$, these speeds and inclination angle are set to meet a relation $$V_1 = V_2 \cos \alpha.$$

With this arrangement, as the paper sheet stack P resting on the first transfer surface 66 of the first belt-and-roller assembly 63 is introduced thereby into a paper sheet stack inlet 94 of a V-shaped sectional profile, upper paper sheets in the stack P and lower ones therein are given the same horizontal component of speed by the respectively corresponding belt transfer surfaces 93 and 66, so that the stack can be fed forth without distortion of its shape. In case if the speed of the third belt transfer surface 93 is the same as that of the first belt transfer surface as in the prior-art device, upper paper sheets in the stack in contact with the inclined third belt transfer surface are given slower speed than that given to lower paper sheets in the stack. In consequence, there inevitably results deformation of the stack with upper sheets in the stack rearwardly deviated.

The inclination angle of the third belt transfer surface 93 can be elastically changed to slight extends according to the thickness of height of the stack P as shown by arrow R in FIG. 7. With a paper sheet stack having an excessive thickness, the support arm 85 is rotated counterclockwise about the shaft 84 against the force of a spring 86 to raise the center roller shaft 82, and the front roller shaft 81 is also raised via a belt 79 and the support arm 83. In consequence, the gap between the first and second transfer surfaces 66 and 80 is increased. The front and center roller shafts 81 and 82 are loosely engaged in and guided by respective vertical slots 95 and 96 shown by broken lines in FIG. 7. These slots 95 and 96 are formed in a vertical frame 97 as shown in FIG. 8.

As shown in FIG. 8, the first, second and third belt-and-roller assemblies 63, 64 and 65 each actually consist of a plurality of parallel belt-and-roller units spaced apart crosswise and individually including the respective belts and rollers as described in connection with FIG. 7. In FIG. 8, the same parts are designated by the same reference numerals. Of course, it is possible to use a single wide belt instead of a plurality of narrow belts as in this embodiment.

FIGS. 9 and 10 show an improved arrangement of the paper sheet transfer portion between the feed-in device and the upper and lower transfer assemblies in the rotary body.

FIG. 10 shows a specific mutual positional relation between the lower transfer assembly 25 of the rotary body 16 and the first belt-and-roller assembly 63 of the feed-in device 32.

The lower transfer assembly 25 has three parallel belt-and-roller units each including three rollers 100, 101 and 102 and a narrow endless belt 103 passed round these rollers. These units are spaced apart crosswise along roller shafts 104, 105 and 106.

The first belt-and-roller assembly 63, which is shown in FIG. 10 only for its portion adjacent to the transfer region, has four parallel belt-and-roller units each including a narrow endless belt 107 and a front roller 108, round which the belt is passed. These four units are spaced apart crosswise along a common front roller shaft 109.

As is seen from FIG. 10, end portions 63*a* of the individual units of the first belt-and-roller assembly 63 and corresponding end portions 25*a* of the individual belt-and-roller units of the lower transfer assembly 25 are in an interdigital arrangement, with the end portions 25*a* each projecting to a certain extent into the space 112 defined between adjacent end portions 63*a*, each of which conversely projects into the space 110 defined between adjacent end portions 25*a*.

A similar interdigital arrangement of end portions is adopted for the combination of the upper transfer assembly 24 and the second belt-and-roller assembly 64 of the feed-in device as well, and this will be readily understood from FIG. 9.

This interdigital arrangement adopted for the paper sheet stack transfer region eliminates undesired gap between the feed-in device 32 and the upper and lower transfer assemblies 24 and 25 and ensures reliable transfer of the stack from the former to the latter without the possibility for some paper sheets of the stack, particularly the uppermost and lowermost paper sheets, to be caught by belts and detached.

This interdigital arrangement may also be adopted for the transfer region between the lower transfer assembly 25 and the feed-out device 33.

FIG. 11 shows stacked paper sheets P in their state being clamped between and transferred by the first and second belt-and-roller assemblies 63 and 64 of the feed-in device 32. The proposal here resides in a special spacing of the parallel endless belts of each belt-and-roller assembly. Paper sheets to be processed by the processing machine usually have certain portions which are most likely to be broken or damaged during use, as shown in FIG. 12. These portions are the edges of the sheets and also portions containing creases 113 which are produced by folding or doubly folding the sheets, and many repaired portions 114 are found in such portions which are most probable to be damaged. Therefore, when a number of paper sheets are stacked, repaired portions overlap to produce irregularities of the thickness of the stack P, the irregularities being greater as the thickness of the stack is larger. If the belts are adapted to clamp portions of the stack P other than those containing many overlapped repaired portions when transferring the stack, a uniform pressure can be applied to the stack P. Also, this arrangement is effective for preventing deformation of the stack shape that might cause jamming or skewing of the stacked sheets.

From the above considerations, the individual belts 107 and 115 in the arrangement of FIG. 11 are spaced apart such that they correspond to portions of the paper sheets other than those which are presumed to contain repaired portions 114.

The spacing of the belts is set in conformity to a paper sheet of a given size, so that it is effective for paper sheets of different sizes, but it is very effective for apparatus of a specification for dealing with processed paper sheets of similar sizes. This construction may be applied not only to the feed-in device 32 but also to the feed-out device 33.

What we claim is:

1. A paper sheet bundling apparatus for a paper sheet processing system in which stacked paper sheets are bundled in a bundling position with a thermally fusible bundling tape during a bundling operation, said bundling tape having a leading end portion and a trailing end portion, said apparatus comprising:

a stationary frame;

a rotary body supported within said frame and rotatable about an axis from a normal position;

locating means provided within said rotary body and serving to locate the paper sheet stack in the bundling position, said locating means being disposed such that the leading end portion of the bundling tape is pushed by a leading end of the paper sheet stack when the paper sheet stack is fed into the bundling position, and then rests on an upper surface of the paper sheet stack;

paper sheet stack feed-in means for feeding the paper sheet stack into said locating means;

bundled paper sheet stack feed-out means for receiving the bundled paper sheet stack from said locating means after the bundling operation;

means for clamping the paper sheet stack in the bundling position;

means for moving the clamping means in a direction having a perpendicular component with respect to the direction of transfer of the paper sheet stack between a clamp position, at which the paper sheet stack is held in the bundling position, and a clear position at which the paper sheet stack is released, said clamping means rotating together with said rotary body during the bundling operation while in said clamp position;

heat receiving means, separate and independent from said clamping means, and having a back side surface and an upper surface, for holding the leading end portion of the bundling tape between the back side surface and the upper surface of the paper sheet stack, said heat receiving means being interposed between the paper sheet stack and the bundling tape wound around the paper sheet stack during the bundling operation;

means, separate and independent from said clamping means moving means, for moving said heat receiving means in a crosswise direction with respect to the direction of movement of said clamping means moving means and with respect to the direction of transfer of the paper sheet stack; and heating means, facing the upper surface of said heat receiving member, for pressing the trailing end portion of the bundling tape to overlap and fuse with the tape wound around the paper sheet stack with said heat receiving means supporting the overlapped tape during the fusing operation.

2. A paper sheet bundling apparatus according to claim 1, wherein said heat receiving means is disposed on one side of the paper sheet stack located in the bundling position and has an outwardly curved contact surface formed on said back side surface.

3. The paper sheet bundling apparatus according to claim 1, wherein, when taking the first position, the heating means abuts against the tape in such inclined direction with respect to the trailing end portion of the tape as causes the trailing end portion of the tape to be wound about the stack to a greater extent.

* * * * *